US008967325B1

(12) United States Patent
Cronhelm

(10) Patent No.: US 8,967,325 B1
(45) Date of Patent: Mar. 3, 2015

(54) SOUND SUPPRESSOR COOLING SYSTEM

(76) Inventor: Peter William Cronhelm, Calgary (CA)

( * ) Notice: Subject to any disclaimer, the term of this patent is extended or adjusted under 35 U.S.C. 154(b) by 482 days.

(21) Appl. No.: 13/137,270

(22) Filed: Aug. 3, 2011

Related U.S. Application Data

(60) Provisional application No. 61/400,851, filed on Aug. 4, 2010.

(51) Int. Cl.
*F41A 21/30* (2006.01)

(52) U.S. Cl.
CPC ..... *F41A 21/30* (2013.01)
USPC ..... 181/223; 89/14.4

(58) Field of Classification Search
USPC ..... 181/223; 89/41.1, 14.4
See application file for complete search history.

(56) References Cited

U.S. PATENT DOCUMENTS

| | | | | |
|---|---|---|---|---|
| 2,792,760 | A * | 5/1957 | Hammer | 89/14.2 |
| 3,047,208 | A | 7/1962 | Coanda | |
| 4,291,610 | A | 9/1981 | Waiser | |
| 4,588,043 | A | 5/1986 | Finn | |
| 7,073,426 | B1 | 7/2006 | White | |
| 7,931,118 | B1 | 4/2011 | Cronhelm | |
| 2010/0180759 | A1 * | 7/2010 | Petersen | 89/14.4 |

* cited by examiner

*Primary Examiner* — Jeremy Luks

(57) ABSTRACT

A firearm sound suppressor cooling system comprising a sound suppressor housing with means for reducing the pressure of gases exiting from a discharged firearm with a shroud that is attached to the exterior of the sound suppressor housing, an annular chamber formed between the sound suppressor housing and the shroud, and a nozzle positioned at the distal end of the sound suppressor and the shroud. The nozzle produces a suction effect upon discharge of the firearm and due to the suction effect, ambient air is aspirated through the annular chamber, and cools the firearm sound suppressor.

12 Claims, 20 Drawing Sheets

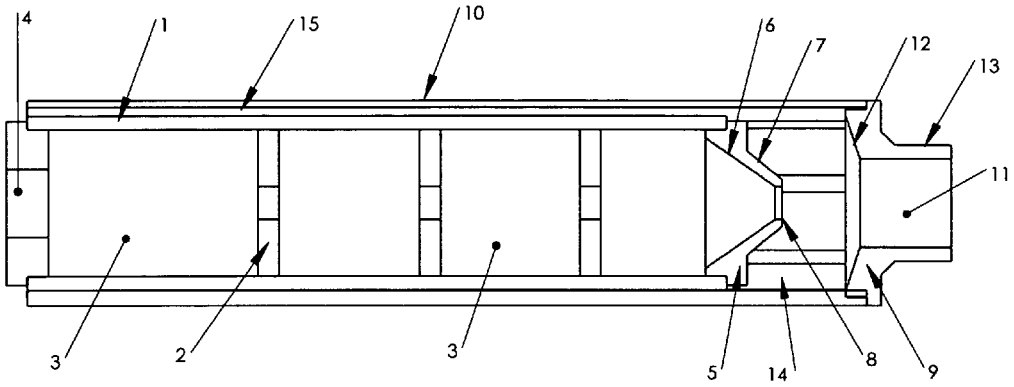
Fig. 1
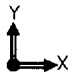

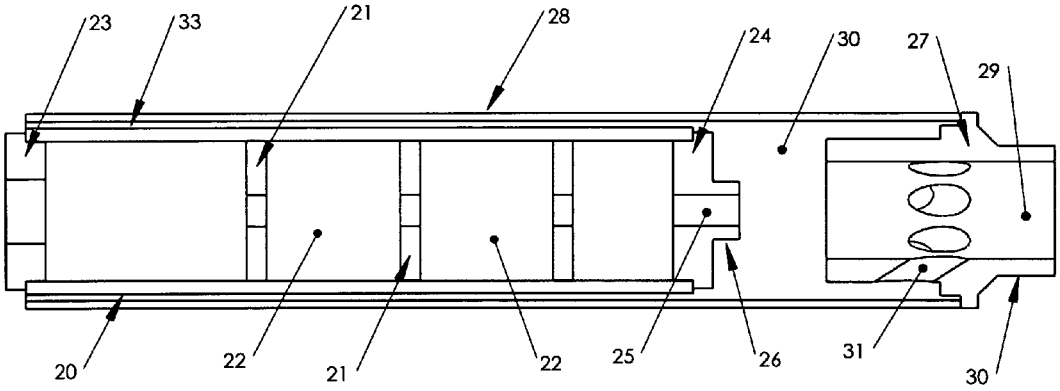
Fig. 2
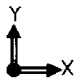

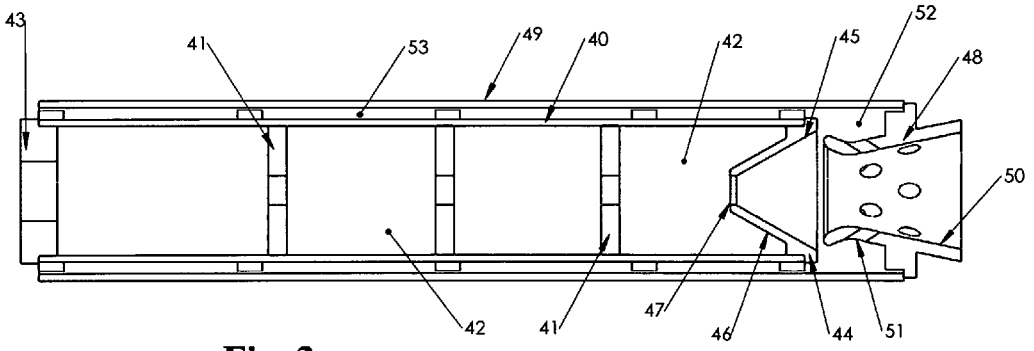
Fig. 3
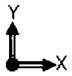

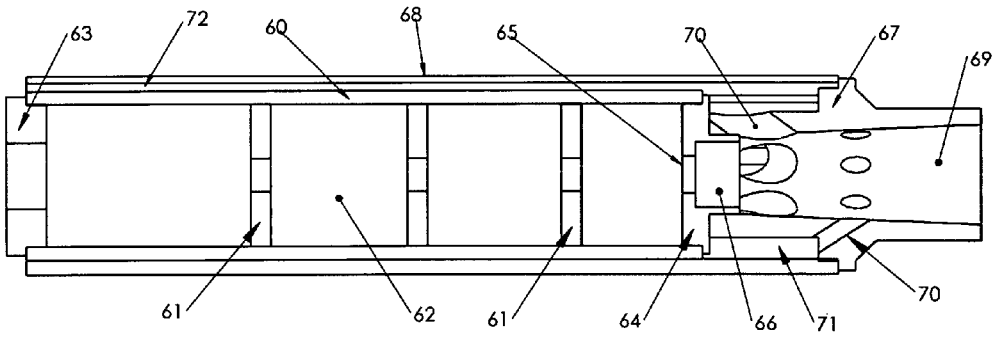
Fig. 4
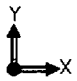

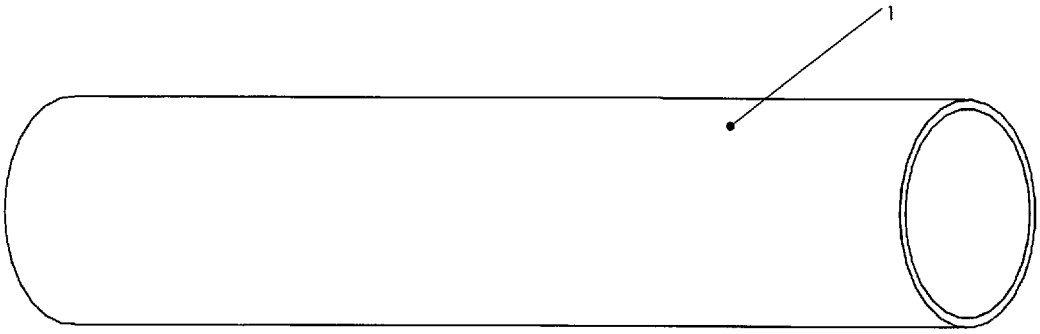
Fig. 5A
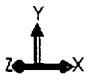

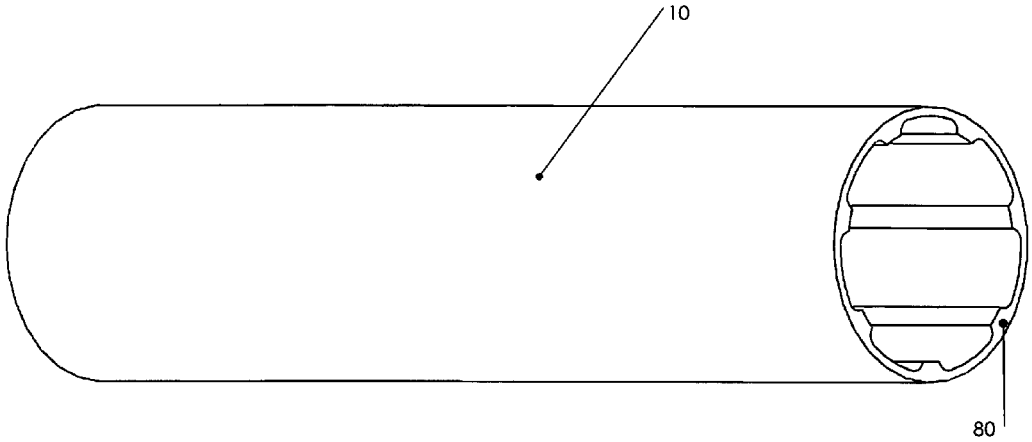
Fig. 5B
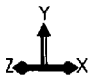

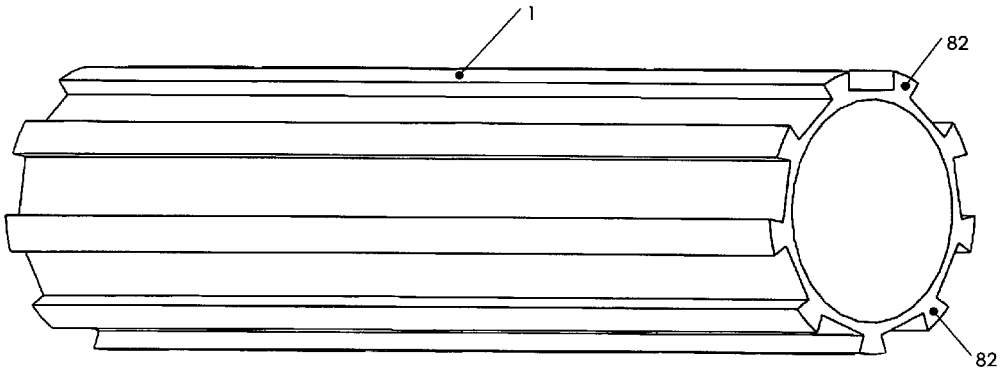
Fig 6A
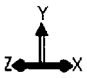

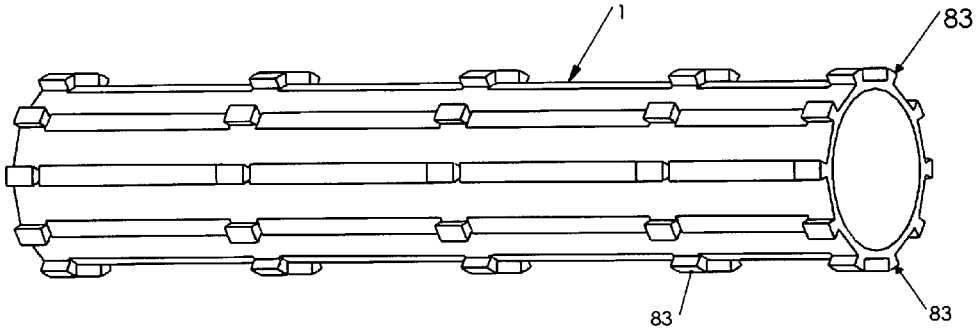
Fig. 6B
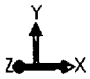

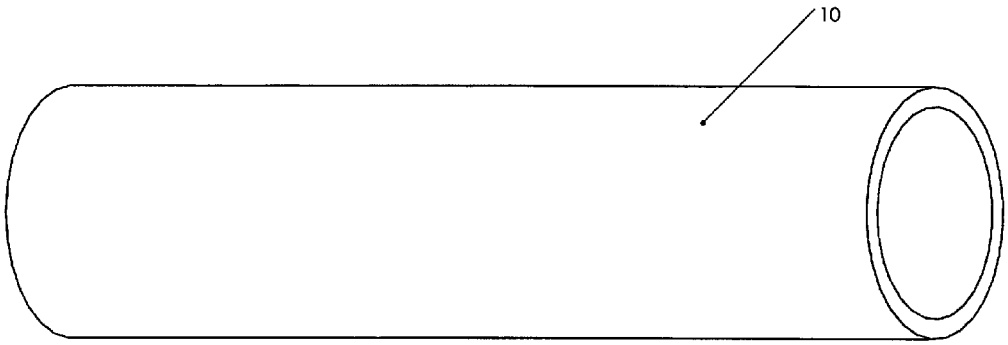
Fig. 6C
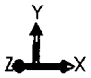

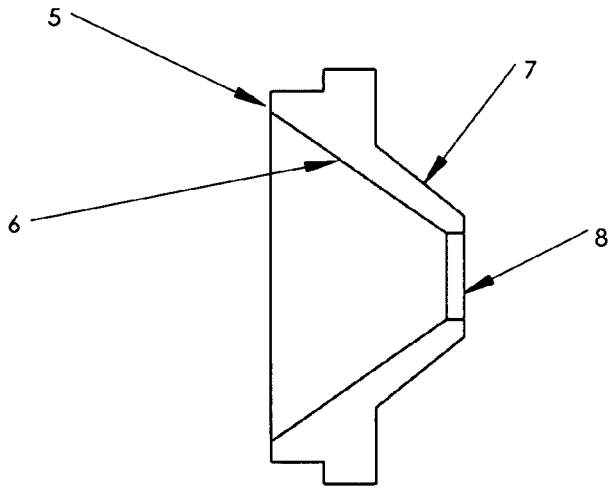
Fig. 7A
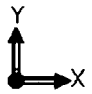

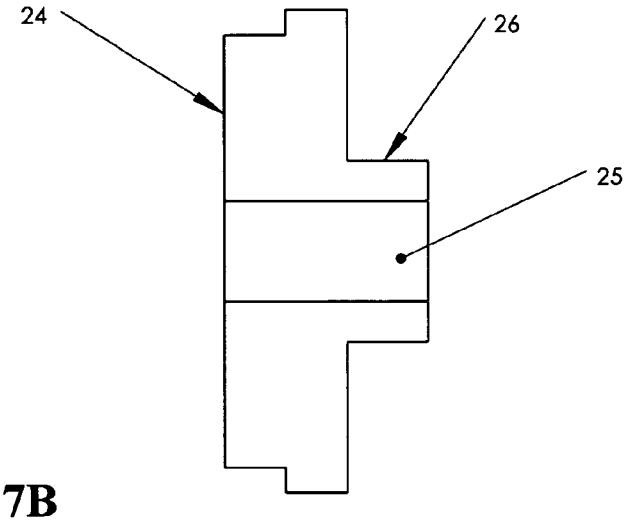
Fig. 7B
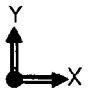

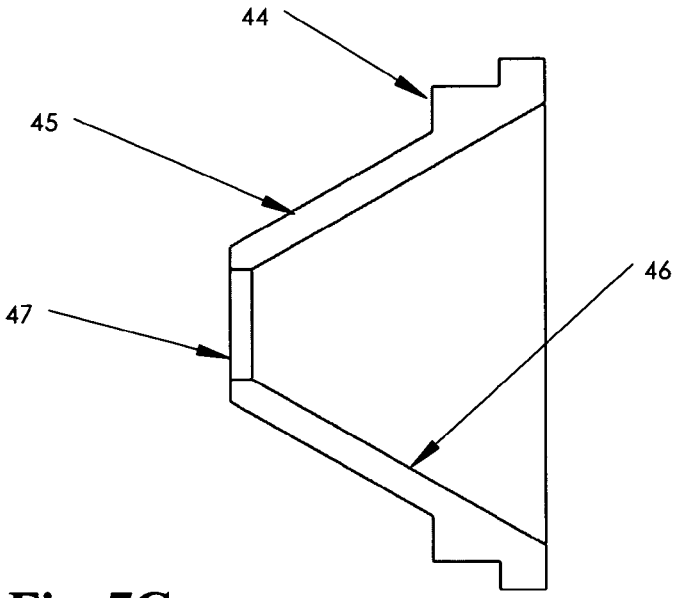
Fig. 7C
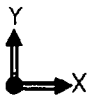

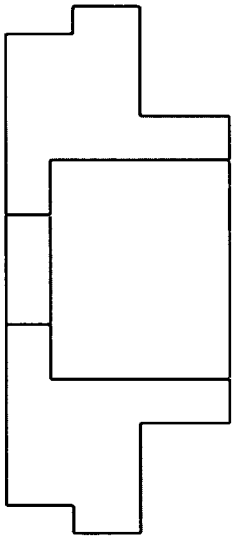
Fig. 7D
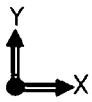

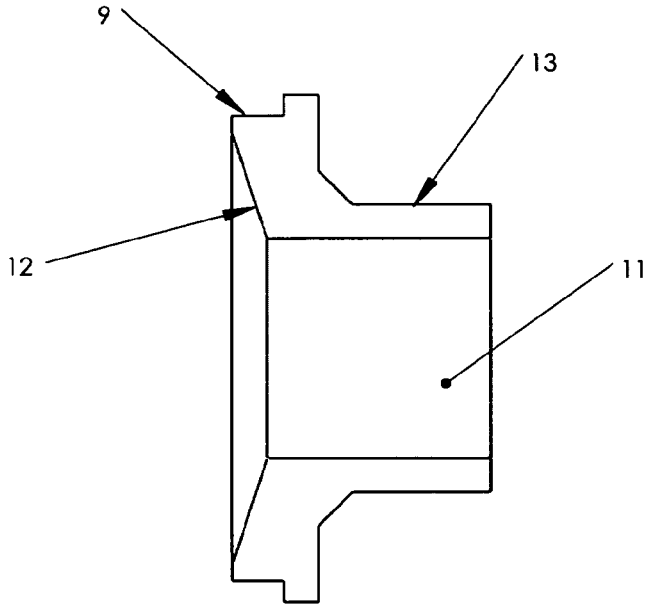
Fig. 8A
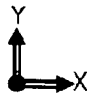

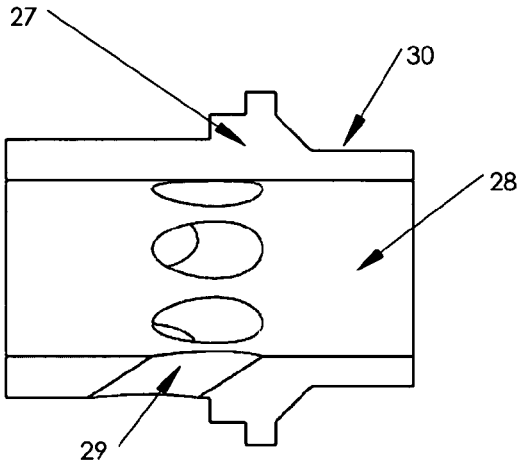
Fig. 8B
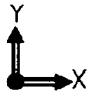

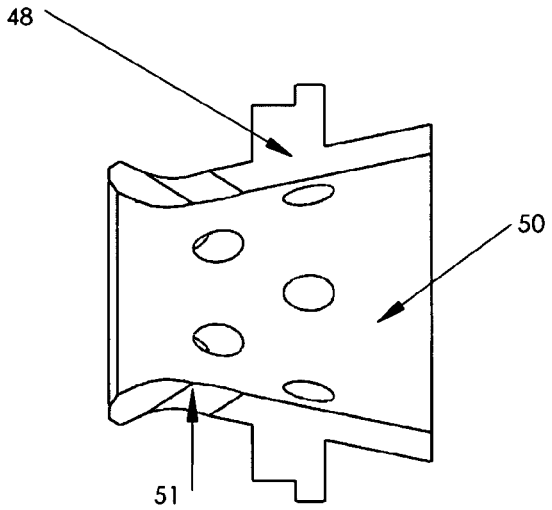
Fig. 8C
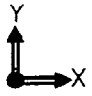

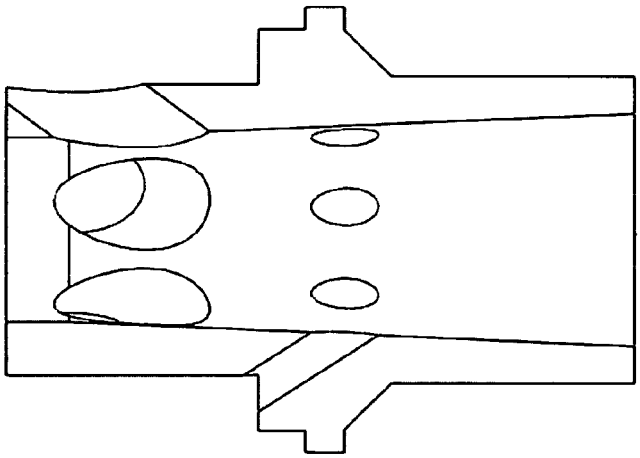
Fig. 8D
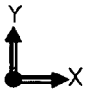

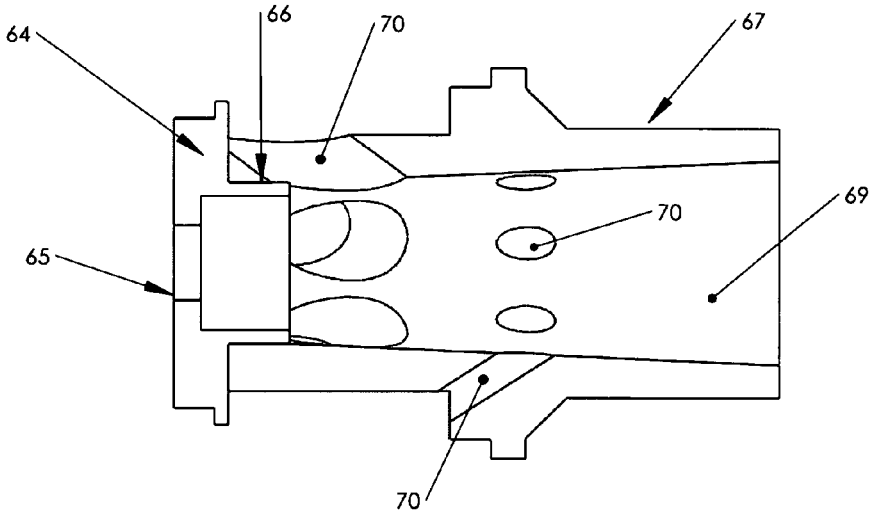
Fig. 9
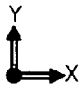

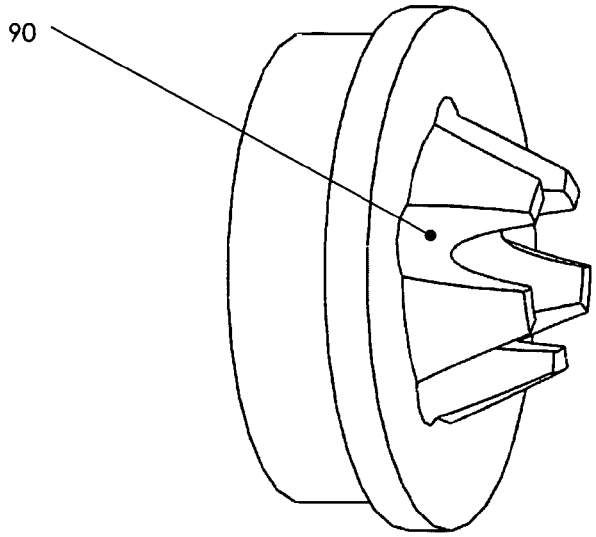
Fig. 10A
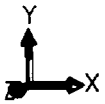

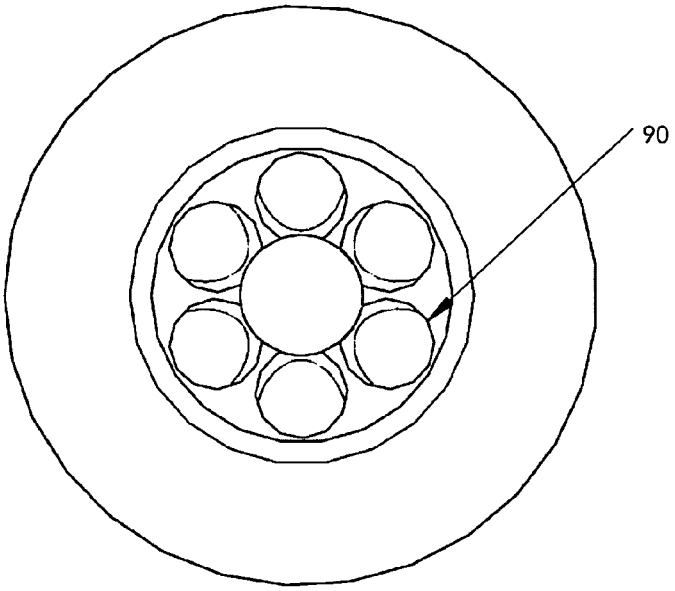
Fig. 10B
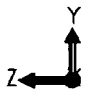

SOUND SUPPRESSOR COOLING SYSTEM

CROSS REFERENCED TO RELATED APPLICATIONS

This application claims the benefit of U.S. Provisional Patent Application No. 61/400,851, filed Aug. 4, 2010, which is incorporated by reference herein.

BACKGROUND OF THE INVENTION

1. Field of the Invention

This application relates broadly to sound suppressors for firearms. More particularly, it concerns a cooling system for a firearm sound suppressor, and allows for the cooling of a firearm sound suppressor through the use of a cooling system attached to a firearm sound suppressor or being integral to a firearm sound suppressor.

2. Description of the Prior Art

Sound suppressors are intended to capture, cool and delay the exit of hot muzzle gases from a firearm. If the firearm sound suppressor is efficient in reduction of the discharge sound, the sound suppressor will experience an increase in temperature during firing as the longer the gases are retained within the suppressor, the higher the temperature of the suppressor. The temperature will also increase with the number of shots fired through the suppressor, and with the wide spread use of suppressed semi-automatic and automatic rifles, there are a number of problems that end users can face that are caused by the increase in temperature when firing occurs. When used with a semi-automatic or automatic rifle or machinegun, the temperature increases rapidly with the firing rate. Prolonged firing will result in structural damage and eventual failure unless the sound suppressor is constructed from high-temperature resistant metals such as stainless steels or other steel alloys like austenitic nickel-chromium based super alloys such as Inconel™.

These materials have drawbacks and these include increased weight, problems with machining, and cost compared to other steel alloys. Even using these materials, prolonged or extreme firing will eventually result in degradation of the structural integrity of the suppressor and failure of the suppressor itself. The high temperatures from such extreme firing i.e. continuous automatic fire of 400 or more rounds can contribute to the eventual failure. The continuous training schedules of anti-terrorist and military personnel means that suppressors used on their small arms are exposed to high round counts daily or weekly. The life span of some modern suppressors may be as short as 5-7000 rounds if used with short barreled automatic rifles while with other automatic rifles, the life span may be as high as 40-50,000 rounds, this being highly dependent upon the use of the sound suppressor.

The use of stainless steel alloys and austenitic nickel-chromium based super alloys has become popular with suppressor manufacturers to compensate for the use and abuse of suppressors by end-users such as anti-terrorist personnel and special military units. Even with the use of high strength steel alloys, machine gun suppressors require thicker internal structures to maintain strength at very high operating temperatures. With the drawbacks of increased weight and cost, some manufacturers have resorted to standard engineering practices such as thinning out the structures while at the same time attempting to maintain structural integrity. Some have used stamped thin metal baffles welded together to form an assembly. Some of these suppressors have been somewhat successful; others have not. Even with such super alloys, extreme usage will eventually result in component failure and temperature is a major factor in the failure of sound suppressor components. The retention of heat in the sound suppressor from multiple shots is a major problem with sound suppressors for use with short barreled automatic rifles, automatic rifles and machine guns.

Other current sound suppressors use titanium to help reduce weight but at the same time maintain structural integrity. Titanium has a very high strength-to-weight ratio and is currently being used to produce sound suppressors that are light in weight when compared to stainless steel or super alloys such as Inconel™. The main problem with titanium when used with sound suppressors is that while the weight factor is ideal, the suppressors are not suitable for use with automatic small arms such as assault rifles and machineguns. The main reason is that the heat from prolonged semi-auto or automatic fire results in eventual failure of the suppressor components in much the same manner as prolonged semi-automatic or automatic fire with stainless steel suppressors. The titanium suppressor will begin to fail at a much lower temperature than a stainless steel suppressor. A temperature of approximately 800 degrees F. for the titanium suppressor will start to result in failure while a temperature of approximately 1200 degrees F. will start to result in the failure of the stainless steel suppressor. While the reduced weight provides a large advantage, again it is prolonged semi-automatic or automatic firing that will eventually result in failure of the suppressor.

Another problem facing the users of sound suppressors, more so with suppressed sniper rifles, is that of heat mirage. Heat mirage is optical distortion caused by heat waves rising directly from the sound suppressor in front of the telescopic sight. After shooting in hot environments, this can cause the sniper to miss the target and this may be critical in military operations. Some shooters use mirage shields to minimize the effects of heat mirage but this means an extra piece of equipment to carry when in the field.

To reduce the temperature of the sound suppressor when used with small arms such as semi-automatic and automatic rifles, suppressed sniper rifles, and machineguns, it is proposed that a unique cooling system be used. This is ideally an integral part of a sound suppressor, though it may be retrofitted to an existing sound suppressor or it may be a detachable system.

The present invention utilizes the firearm sound suppressor to act as a host for a cooling system that provides for cool ambient air to be drawn around the outer surface of the sound suppressor by the creation of a suction effect during the firing of the host firearm. A shroud is fitted over the outside or external surface of the sound suppressor and this shroud may extend for the entire length of the sound suppressor or may be shorter if so desired. An annular gap is created between the outside surface of the sound suppressor and inside surface of the shroud. At the distal or front end of the sound suppressor, a structure is positioned that provides a suction effect, and the shroud is attached to this structure. This structure is positioned forward of the front end and exit hole of the sound suppressor and a stand-off distance or space is created between the exit hole of the sound suppressor and the bore hole of the structure.

When the host firearm is discharged, the hot propellant gases expand into the sound suppressor and are then discharged from the sound suppressor at a greatly diminished pressure level and sound level. These pressurized gases expand forward into the space between the front end cap of the suppressor and the structure and upon discharging into the atmosphere through the structure, create a vacuum or ejector effect. The pressure of the discharging gases is more than sufficient to create a vacuum effect. This results in cool ambient air being sucked into the air gap or space between the outside of the sound suppressor and the inside of the shroud, at the rear end of the shroud, and then forward into the structure and then into the atmosphere through the structure. Even one or two shots fired from a bolt action rifle are sufficient to create the suction effect and provide cooling of the sound suppressor.

Small vanes may be provided to the cooling system to provide additional cooling and may also enhance the performance of the cooling structure by increasing the surface area for heat to be transferred from the suppressor to the cooling air flow. In one embodiment, the vanes may be positioned on the external surface of the sound suppressor with the shroud fitting closely over the vanes. This will provide an additional cooling effect by increasing the heat transfer from the sound suppressor to the shroud and hence to the atmosphere. To enhance the flow of the cool air around the outside surface of the sound suppressor, the vanes may be provided with a helical twist to induce motion in the flow of cool air being sucked forward and increase the mixing effectiveness of the cool air stream with the hot muzzle gases in the structure. In an alternate embodiment, the vanes may be positioned on the internal surface of the shroud, providing a spacing effect between the shroud plus structural integrity to the shroud as well as the additional cooling from the sound suppressor to the shroud.

BRIEF SUMMARY OF THE INVENTION

The present invention provides unique improvements to firearm sound suppressors comprising: a cooling system that utilizes a shroud fitting over a firearm sound suppressor and a suction structure that provides for suction of ambient air around the surface of a firearm sound suppressor; a cooling system that utilizes a suction structure that features a convergent-divergent structure to enhance flow and cooling of the firearm sound suppressor; and a cooling system that utilizes vanes that space the shroud from the firearm sound suppressor, provide support to the shroud, and provide additional cooling to the system by increasing heat transfer from the sound suppressor to the shroud.

The present invention discloses a cooling system for a firearm sound suppressor, which may be provided as a system that may be integral with a firearm sound suppressor or as a separate system that may be attached to an existing firearm sound suppressor. A suction structure is provided and used in conjunction with a shroud that fits over the firearm sound suppressor. This suction structure uses the kinetic energy of the propellant gases from the firearm sound suppressor as a driving fluid to aspirate cool ambient air through an annular gap formed by the external surface of the firearm sound suppressor and the internal surface of the shroud. The cool ambient air cools the external surface of the firearm sound suppressor.

The suction structure may be a simple arrangement of a shroud connected to a tubular nozzle or may be more complex by the use of a nozzle with a convergent-divergent flow surface. Regardless of the arrangement of the suction structure, a chamber is formed between the front end of the sound suppressor and the support structure for the nozzle. A tubular protrusion may be added to the front end of the sound suppressor and this directs the gases forward into the chamber and then into the nozzle. The inside of the support structure may be provided with a convergent or forwardly tapered surface that assists in compressing the expanding muzzle gases and in turn enhancing the suction effect when used in conjunction with a tubular nozzle that protrudes forward of the support structure. The tubular nozzle allows the muzzle gases to flow forward and creating a suction effect, aspirating cool ambient air through the annular gap between the sound suppressor and the shroud and cooling the sound suppressor. One shot is enough to create a suction effect and for subsequent cooling to occur.

In another embodiment, the suction structure may comprise an annular shroud connected to a nozzle featuring a convergent-divergent flow surface. A chamber is formed between the front end of the sound suppressor and the support structure for the nozzle. In this embodiment, the nozzle has a convergent-divergent flow surface and this provides compression of the muzzle gases with a subsequent expansion, creating a suction effect. The suction effect aspirates cool ambient air through the annular gap between the sound suppressor and the shroud and aids in cooling the sound suppressor. The nozzle may also use the coanda effect to enhance flow through the nozzle as opposed to a nozzle using a conventional convergent-divergent flow surface. The coanda nozzle uses curved surfaces to enhance flow through the nozzle while at the same time aspirating cool ambient air through the annular gap between the sound suppressor and the shroud.

In other embodiments, the cooling system may be provided with vanes positioned between the sound suppressor and the shroud. These vanes may be used for additional cooling purposes. The vanes may be positioned on the external surface of the firearm sound suppressor with the shroud fitting over the vanes, thus creating an annular gap that is divided into longitudinal channels through which the cool ambient air is sucked into when the host firearm is fired and the hot muzzle gases create a suction or venturi effect. The vanes also increase the cooling effect by increasing the heat transfer from the sound suppressor to the vanes to the shroud and to the atmosphere.

In another embodiment featuring vanes, the vanes may be provided with a helical twist so that the annular gap between the firearm sound suppressor and the shroud is divided into helical shaped longitudinal channels. The cool ambient air sucked into these channels is thus provided with a swirling motion due to the helical shape of the longitudinal channels. This swirling of the cool ambient air, when mixed with the hot muzzle gases inside the suction structure, increases the mixing effectiveness of the two fluid streams within the suction structure. With the embodiments featuring vanes, the vanes also serve as a support for the shroud and strengthening the cooling system.

The present invention holds significant improvements and serves as a cooling system for firearm sound suppressors. These and other features, aspects, and advantages of the present invention will become better understood with reference to the following drawings and description.

BRIEF DESCRIPTION OF THE DRAWINGS

FIG. 1 shows a cross-sectional view of a sound suppressor with the cooling system, illustrating a suppressor with baffles positioned along an interior of a housing, and a shroud and a nozzle positioned at the distal end of the sound suppressor, according to one embodiment of the present invention.

FIG. 2 shows a cross-sectional view of a sound suppressor with the cooling system, illustrating a suppressor with baffles positioned along an interior of a housing, and a shroud and nozzle positioned at the distal end of the sound suppressor, according to another embodiment of the present invention.

FIG. 3 shows a cross-sectional view of a sound suppressor with the cooling system, illustrating a suppressor with baffles positioned along an interior of a housing, and a shroud and nozzle positioned at the distal end of the sound suppressor, according to another embodiment of the present invention.

FIG. 4 shows a cross-sectional view of a sound suppressor with the cooling system, illustrating a suppressor with baffles positioned along an interior of a housing, and a shroud and nozzle positioned at the distal end of the sound suppressor, according to yet another embodiment of the present invention.

FIG. 5A shows a perspective view of one embodiment of a suppressor housing and FIG. 5B shows a perspective view of one embodiment of a cooling shroud.

FIGS. 6A and 6B show two perspective views of various embodiments of suppressor housings and FIG. 6C shows a perspective view of one embodiment of a cooling shroud.

FIGS. 7A, 7B, 7C and 7D show cross-sectional views of four different embodiments of a inner front end cap.

FIGS. 8A, 8B, 8C and 8D show cross-sectional views of four different embodiments of a outer front end cap.

FIG. 9 shows a cross-sectional view of a specific embodiment of an inner front end cap and an outer front end cap.

FIGS. 10A and 10B show two alternate embodiments of inner front end caps featuring a plurality of openings from the proximal face through to the distal face of the inner front end cap.

The various embodiments of the present invention will hereinafter be described in conjunction with the appended drawings, wherein like designations denote like elements.

DETAILED DESCRIPTION

Referring to FIG. 1 showing a cross-sectional view of an embodiment of the present invention, illustrating a sound suppressor with baffles positioned along an interior of the suppressor housing, with a cooling system positioned at the distal end of the sound suppressor and a shroud positioned externally of the sound suppressor. The sound suppressor consists of a hollow cylindrical housing 1, with spaced baffle elements 2, creating a series of expansion chambers 3, between the baffles 2. At the proximal end of the suppressor is a rear end cap 4 and at the distal end of the suppressor an inner front end cap 5 and both of these end caps are secured to the housing 1 preferably by screw threads, by welding or other suitable securing means. The rear end cap 4 may be provided with threads for attachment to a host firearm or alternate attachment methods such as quick detach/connect systems may be used. The inner front end cap 5 has an internal convergent surface 6 and a partially convergent outer surface 7 with a bore hole 8 for a projectile to pass through upon discharge of the host firearm (not shown). Positioned forward of the exit end cap is the outer front end cap 9 that is multi-functional. The outer front end cap 9 provides a support for the cooling shroud 10 that fits over the sound suppressor housing 1, contains a tubular nozzle 11, and also provides a spacing function to position the outer front end cap 9 some distance forward of the inner front end cap 5 of the sound suppressor. The proximal face 12 of the outer front end cap is convergent in shape and has a reduced diameter tubular protrusion 13 on the distal face. An expansion chamber 14 is formed between the inner front end cap 5 and the outer front end cap 9. An annular gap 15 is formed between the shroud 10 and the housing 1.

Referring to FIG. 2 showing a cross-sectional view of another embodiment of the present invention, illustrating a sound suppressor with baffles positioned along an interior of the suppressor housing, with a cooling system positioned at the distal end of the sound suppressor and a shroud positioned externally of the sound suppressor. The sound suppressor consists of a hollow cylindrical housing 20, with spaced baffle elements 21, creating a series of expansion chambers 22 between the baffles 21. At the proximal end of the suppressor is a rear end cap 23 and at the distal end of the suppressor an inner front end cap 24 and both of these end caps are secured to the housing 1 preferably by screw threads, by welding or other suitable securing means. The rear end cap 23 may be provided with threads for attachment to a host firearm or alternate attachment methods such as quick detach/connect systems may be used. The inner front end cap 24 has a bore hole 25 for a projectile to pass through upon discharge of the host firearm (not shown) and a reduced diameter protrusion 26. Positioned forward of the inner front end cap is the outer front end cap 27 that is multi-functional. The outer front end cap 27 provides a support for the cooling shroud 28 that fits over the sound suppressor housing 20, and contains a tubular nozzle 29 and has a reduced diameter protrusion 30 on the distal face of the outer front end cap 27. The tubular nozzle 29 has a series of angled holes 31 that are angled towards the proximal end of the suppressor and these assist in creating a suction effect that in turn assists in cooling the suppressor. An expansion chamber 32 is formed between the inner front end cap 24 and the outer front end cap 26. An annular gap 33 is formed between the shroud 28 and the housing 20.

Referring to FIG. 3 showing a cross-sectional view of yet another embodiment of the present invention, illustrating a sound suppressor with baffles positioned along an interior of the suppressor housing, with a cooling system positioned at the distal end of the sound suppressor and a shroud positioned externally of the sound suppressor. The sound suppressor consists of a hollow cylindrical housing 40, with spaced baffle elements 41, creating a series of expansion chambers 42, between the baffles 41. At the proximal end of the suppressor is a rear end cap 43 and at the distal end of the suppressor an inner front end cap 44 and both of these end caps are secured to the housing 1 preferably by screw threads, by welding or other suitable securing means. The rear end cap 43 may be provided with threads for attachment to a host firearm or alternate attachment methods such as quick detach/connect systems may be used. The inner front end cap 44 has a divergent internal surface 45 and a corresponding divergent outer surface 46 with a bore hole 47 for a projectile to pass through upon discharge of the host firearm (not shown). Positioned forward of the inner front end cap is the outer front end cap 48 that is multi-functional. The outer front end cap 48 provides a support for the cooling shroud 49 that fits over the sound suppressor housing 40, contains a modified convergent-divergent coanda nozzle 50, and also provides a spacing function to position the outer front end cap 48 a short distance forward of the inner front end cap 44 of the sound suppressor. The convergent-divergent coanda nozzle 50 is modified by the provision of two series of angled suction holes 51 that are angled towards the proximal end of the suppressor and improve the suction effect provided by the modified convergent-divergent coanda nozzle. An expansion chamber 52 is formed between the inner front end cap 44 and the outer front end cap 48. An annular gap 53 is formed between the shroud 49 and the housing 40.

Referring to FIG. 4 showing a cross-sectional view of another embodiment of the present invention, illustrating a sound suppressor with baffles positioned along an interior of the suppressor housing, with a cooling system positioned at the distal end of the sound suppressor and a shroud positioned externally of the sound suppressor. The sound suppressor consists of a hollow cylindrical housing 60, with spaced baffle elements 61, creating a series of expansion chambers 62, between the baffles 61. At the proximal end of the suppressor is a rear end cap 63 and at the distal end of the suppressor an inner front end cap 64 and both of these end caps are secured to the housing 60 preferably by screw threads, by welding or other suitable securing means. The rear end cap 63 may be provided with threads for attachment to a host firearm or alternate attachment methods such as quick detach/connect systems may be used. The inner front end cap 64 has a tubular bore hole 65 for a projectile to pass through upon discharge of the host firearm (not shown). The inner front end cap has a short forward reduced diameter protrusion 66 that has an increased size bore as compared to bore hole 65. Positioned forward of the inner front end cap is the outer front end cap 67 that is multi-functional. The outer front end cap 67 provides a support for the cooling shroud 68 that fits over the sound suppressor housing 60, and contains a shallow divergent nozzle 69. Divergent nozzle 69 is provided with two series of angled holes 70 that assist in creating a suction effect. Inner front end cap 64 and outer front end cap 67 create an assembly when fitted together. An expansion chamber 71 is formed around the proximal end of the outer front end cap 67 when inner front end cap 64 and outer front end cap 67 are fitted together. An annular gap 72 is formed between the shroud 68 and the housing 60.

Referring to FIG. 5A showing a perspective view of a suppressor housing (1, in FIG. 1) and FIG. 5B showing a perspective view of a shroud (10 in FIG. 1) with longitudinal vanes 80. Reference numbers 1 and 10 (as used in FIG. 1) are used here for reference purposes only, as the embodiments shown in FIGS. 2, 3, and 4 feature a suppressor housing and a shroud with different reference numbers applicable to those specific embodiments.

Referring to FIG. 6A showing a perspective view of a suppressor housing (1 in FIG. 1) showing longitudinal vanes 82 and FIG. 6B showing a perspective view of another embodiment of a suppressor housing showing shoulders 83, and FIG. 6C showing a perspective view of a shroud (10 in FIG. 1). Reference numbers 1 and 10 (as used in FIG. 1) are used here for reference purposes only, as the embodiments shown in FIGS. 2, 3, and 4 feature a suppressor housing and a shroud with different reference numbers applicable to those specific embodiments.

Referring to FIGS. 7A, 7B, 7C and 7D showing cross-sectional views of various inner front end caps as used with the embodiments shown in FIGS. 1, 2, 3 and 4 respectively. FIG. 7A shows inner front end cap 5 as used in the embodiment shown in FIG. 1 and inner front end cap 5 has an internal convergent surface 6 on the proximal face of the inner front end cap with a partially convergent external surface 7 on the distal face and a bore hole 8 for a projectile to pass through. FIG. 7B shows inner front end cap 24 as used in the embodiment shown in FIG. 2 and inner front end cap 24 has a bore hole 25 for a projectile to pass through and a reduced diameter protrusion 26. FIG. 7C shows inner front end cap 44 as used in the embodiment shown in FIG. 3 and inner front end cap 44 has a divergent surface 45 on the distal face of the inner front end cap with a divergent surface 46 on the proximal face with a bore hole 47 for a projectile to pass through. FIG. 7D shows inner front end cap 64 as used in the embodiment shown in FIG. 4 and inner front end cap 64 has a bore hole 65 for a projectile to pass through and a short forward reduced diameter protrusion on the distal face with an increased size bore 66 as compared to bore hole 65.

Referring to FIGS. 8A, 8B, 8C and 8D showing cross-section views of various outer front end caps as used with the embodiments shown in FIGS. 1, 2, 3 and 4 respectively. FIG. 8A shows outer front end cap 9 as used with the embodiment shown in FIG. 1 and outer front end cap 9 has a tubular nozzle 11 with a shallow convergent internal surface 12 positioned on the proximal face of the outer front end cap and a reduced diameter tubular protrusion 13 on the distal face. FIG. 8B shows outer front end cap 27 as used with the embodiment shown in FIG. 2 and outer front end cap 27 has a tubular nozzle 29 with a reduced diameter protrusion on the distal face of the outer front end cap. The tubular nozzle 29 has a series of angled holes 31 that are angled towards the proximal end of the front end cap. FIG. 8C shows outer front end cap 48 as used with the embodiment shown in FIG. 3 and outer front end cap 48 is a modified convergent-divergent coanda nozzle 50 with two series of angled holes 51 that are angled towards the proximal end of the outer front end cap. FIG. 8D shows outer front end cap 67 as used with the embodiment shown in FIG. 4 and outer front end cap 67 has a shallow divergent nozzle 69. Divergent nozzle 69 is provided with two series of angled holes 70 that are angled towards the proximal end of the outer front end cap.

Referring to FIG. 9 showing cross-section views of an inner front end cap 64 and outer front end cap 67 that are used as a specific embodiment. The inner front end cap 64 has a bore hole 65 for a projectile to pass through and a short forward reduced diameter protrusion 66 that has an increased size bore as compared to bore hole 65. The outer front end cap 67 has a shallow divergent nozzle 69 and has two series of angled holes 70 that are angled towards the proximal end of the outer front end cap. The outer front end cap 67 is modified at its proximal end to allow for the forward reduced diameter protrusion 66 to fit into the proximal end of the outer front end cap. This forms an assembly that is secured together by such means as welding or silver soldering.

Referring to FIGS. 10A and 10B showing a perspective view of an alternate inner front end cap with a plurality of openings and a front face view of an alternate inner front end cap respectively. FIG. 10A shows a modified inner front end cap as used in FIG. 4 with a series of holes 90 arranged around the bore hole and these holes perforate the inner front end cap while FIG. 10B shows the arrangement of holes 90 around the bore hole.

The sound suppressor cooling system shown in FIG. 1 comprises a shroud 10 that fits over the sound suppressor, and the outer front end cap 9. The shroud is cylindrical and an annular gap 15 is formed between the inside surface of the shroud and the outside surface of the host sound suppressor 1. It should be understood that the described shape is for descriptive purposes only, and the shape of the shroud may vary depending upon the shape of the host sound suppressor. The shroud may cover a portion of the host sound suppressor or it may cover the entire length as shown in FIG. 1. To ensure that the shroud is supported at its proximal and distal ends, the host sound suppressor may be provided with shoulders, bearing surfaces or flutes while the inside surface of the shroud may be smooth. Such arrangements are shown in FIGS. 6A and 6B where longitudinal vanes or flutes 82 and circumferential bearing surfaces or shoulders 83 are shown with a shroud having a smooth inside surface. Alternatively, the shroud 10 may be provided with circumferential bearing surfaces or shoulders or longitudinal vanes or flutes and one such arrangement of support is shown in FIG. 5B where longitudinal flutes 80 are shown on the internal surface of a shroud 10 with the outside surface of the host suppressor being smooth as shown in FIG. 5A. Such arrangements of longitudinal vanes or flutes, or circumferential bearing surfaces or shoulders may be used depending upon the type of host firearm that the suppressor is used with, such as a machine gun or an automatic rifle. The longitudinal vanes or flutes, and circumferential bearing surfaces or shoulders provide support to the shroud regardless of the longitudinal vanes or flutes, or circumferential bearing surfaces or shoulders being positioned externally on the suppressor housing or internally on the shroud. These support features also assist in heat transfer from the sound suppressor to the shroud via the support features. The proximal and distal bearing surfaces or shoulders are provided with recesses that allow for the ambient air to be aspirated from the proximal end towards the distal end. The forward or distal end of the shroud 10 abuts against a shoulder on the outer front end cap 9. An expansion chamber 14 is formed between the inner front end cap 5 of the host sound suppressor and the outer front end cap 9. This expansion chamber 14 allows for the expansion of the hot muzzle gases from the host sound suppressor and at the same time the cool ambient air sucked into the chamber due to the suction effect produced by the nozzle that is a part of the outer front end cap 9. The distance between the front end of the host sound suppressor and the outer front end cap is somewhat critical in that if the expansion chamber is too large, then there will be little suction achieved. Conversely, if the distance is too small, then little suction will be achieved. The inner front end cap 5 is provided with an internal convergent shape 7 that compresses the muzzle gases exiting the sound suppressor before the gases expand into expansion chamber 14. The outer front end cap 9 performs several functions in that it provides a support for the cooling shroud 10, contains a tubular nozzle 11, and provides a spacing function to position the outer front end cap 9 some distance forward of the inner front end cap 5 of the sound suppressor. The proximal face 12 of the outer front end cap is convergent in shape and has a reduced diameter tubular protrusion 13 on the distal face.

In operation, the cooling system utilizes the hot muzzle gases exiting from the host sound suppressor as a driving fluid to provide aspiration of cool ambient air along the outer surface of the host sound suppressor. The cool ambient air is the driven fluid and this method of operation is the reverse of the conventional air injectors or ejectors. The hot muzzle gases, although much reduced in pressure and heat after passing through the baffles 2 and expansion chambers 3 of the host sound suppressor, are compressed by the internal surface 7 of the inner front end cal before flowing forwards into the expansion chamber 14. The compressed muzzle gases expand before being subject to further compression by the internal surface 7 of the outer front end cap 9 before finally exiting the sound suppressor through the tubular nozzle 11. This expansion, compression and expansion of the hot muzzle gases creates a suction or aspiration effect that results in cool ambient air being sucked in from the proximal end of the host sound suppressor through the annular gap formed by the shroud. This cool air is sucked along the length of the host sound suppressor and results in cooling of the suppressor. In practice, and dependent upon the caliber and the length of the barrel of the host firearm, one or two shots fired through the cooled sound suppressor are sufficient to produce some cooling of the sound suppressor if the host firearm is a bolt action rifle. When used with a semi-automatic or automatic firearm, the rapid succession of shots fired results in a noticeable amount of cooling.

To further enhance the efficiency of the cooling system, the longitudinal vanes or flutes may also be provided with an angled, helical, stepped curvilinear or curvilinear twist, thus providing a third function of inducing a swirling motion in the cool ambient air as it is sucked along the external surface of the host sound suppressor. This swirling motion of the cool air results in improved mixing of the driving fluid and the driven fluid in the expansion chamber.

The sound suppressor cooling system as shown in FIG. 2 is similar to that of FIG. 1 in that it comprises of a shroud 28 that fits over the sound suppressor, and the outer front end cap 27. The shroud is cylindrical and an annular gap 33 is formed between the inside surface of the shroud and the outside surface of the host sound suppressor 20. It should be understood that the described shape is for descriptive purposes only, and the shape of the shroud may vary depending upon the shape of the host sound suppressor. The shroud may cover a portion of the host sound suppressor or it may cover the entire length as shown in FIG. 2. As with the cooling system of FIG. 1, the shroud is supported at its proximal and distal ends and the host sound suppressor may be provided with shoulders, bearing surfaces or flutes while the inside surface of the shroud may be smooth, and the functional aspects are similar to the description relating to the embodiment of FIG. 1 in relation to FIGS. 6A and 6B where longitudinal vanes or flutes 82 and circumferential bearing surfaces or shoulders 83 are shown with a shroud having a smooth inside surface. Alternatively, the shroud 28 may be provided with circumferential bearing surfaces or shoulders or longitudinal vanes or flutes and one such arrangement of support is shown in FIG. 5B where longitudinal flutes 80 are shown on the internal surface of a shroud with the outside surface of the host suppressor being smooth as shown in FIG. 5A. Such arrangements of longitudinal vanes or flutes, or circumferential bearing surfaces or shoulders may be used depending upon the type of host firearm that the suppressor is used with, such as a machine gun or an automatic rifle. The longitudinal vanes or flutes, and circumferential bearing surfaces or shoulders provide support to the shroud regardless of the longitudinal vanes or flutes, or circumferential bearing surfaces or shoulders being positioned externally on the suppressor housing or internally on the shroud. These support features also assist in heat transfer from the sound suppressor to the shroud via the support features. The proximal and distal bearing surfaces or shoulders are provided with recesses that allow for the ambient air to be aspirated from the proximal end towards the distal end. The forward or distal end of the shroud 28 abuts against a shoulder on the outer front end cap 27. An expansion chamber 30 is formed between the inner front end cap 24 of the host sound suppressor and the outer front end cap 27. This expansion chamber 30 allows for the expansion of the hot muzzle gases from the host sound suppressor and at the same time the cool ambient air is sucked into the chamber due to the suction effect produced by the nozzle that is a part of the outer front end cap 27. The distance between the front end of the host sound suppressor and the outer front end cap is somewhat critical in that if the expansion chamber is too large, then there will be little suction achieved. Conversely, if the distance is too small, then little suction will be achieved. The inner front end cap 24 has a forward reduced diameter tubular projection 26. The outer front end cap 27 performs several functions in that it provides a support for the cooling shroud 28, contains a tubular nozzle 29, and provides a spacing function to position the outer front end cap 27 some distance forward of the inner front end cap 24 of the sound suppressor.

The operation of the cooling system of FIG. 2 is similar to that of FIG. 1 in that the hot muzzle gases exiting from the host sound suppressor are used as a driving fluid to provide aspiration of cool ambient air along the outer surface of the host sound suppressor. The cool ambient air is the driven fluid and this method of operation is the reverse of the conventional air injectors or ejectors. The hot muzzle gases, although much reduced in pressure and heat after passing through the baffles 21 and expansion chambers 22 of the host sound suppressor, flow from the host sound suppressor forward into the expansion chamber 30. The compressed muzzle gases expand before flowing forward through the tubular nozzle 27 and pass by the angled holes 31. The flow forward of the pressurized muzzle gases creates a suction effect as the muzzle gases pass by the angled holes 31 and this suction effect or aspiration effect results in cool ambient air being sucked in from the proximal end of the host sound suppressor through the annular gap 33 formed by the shroud 28 and the outside surface of the host sound suppressor 40. This cool air is sucked along the length of the host sound suppressor and results in cooling of the suppressor.

The sound suppressor cooling system as shown in FIG. 3 is similar to that of FIG. 1 in that it comprises of a shroud 49 that fits over the sound suppressor, and the outer front end cap 48. The shroud is cylindrical and an annular gap 53 is formed between the inside surface of the shroud and the outside surface of the host sound suppressor 40. It should be understood that the described shape is for descriptive purposes only, and the shape of the shroud may vary depending upon the shape of the host sound suppressor. The shroud may cover a portion of the host sound suppressor or it may cover the entire length as shown in FIG. 3. As with the cooling system of FIG. 1, the shroud is supported at its proximal and distal ends and the host sound suppressor may be provided with shoulders, bearing surfaces or flutes while the inside surface of the shroud may be smooth, and the functional aspects are similar to the description relating to the embodiment of FIG. 1 in relation to FIGS. 6A and 6B where longitudinal vanes or flutes 82 and circumferential bearing surfaces or shoulders 83 are shown with a shroud having a smooth inside surface. Alternatively, the shroud 28 may be provided with circumferential bearing surfaces or shoulders or longitudinal vanes or flutes and one such arrangement of support is shown in FIG. 5B where longitudinal flutes 80 are shown on the internal surface of a shroud with the outside surface of the host suppressor being smooth as shown in FIG. 5A. Such arrangements of longitudinal vanes or flutes, or circumferential bearing surfaces or shoulders may be used depending upon the type of host firearm that the suppressor is used with, such as a machine gun or an automatic rifle. The longitudinal vanes or flutes, and circumferential bearing surfaces or shoulders provide support to the shroud regardless of the longitudinal vanes or flutes, or circumferential bearing surfaces or shoulders being positioned externally on the suppressor housing or internally on the shroud. These support features also assist in heat transfer from the sound suppressor to the shroud via the support features. The proximal and distal bearing surfaces or shoulders are provided with recesses that allow for the ambient air to be aspirated from the proximal end towards the distal end. The forward or distal end of the shroud 49 abuts against a shoulder on the outer front end cap 48. An expansion chamber 52 is formed between the inner front end cap 45 of the host sound suppressor and the outer front end cap 48. This expansion chamber 52 allows for the expansion of the hot muzzle gases from the host sound suppressor and at the same time the cool ambient air is sucked into the chamber due to the suction effect produced by the nozzle that is a part of the outer front end cap 45. The inner front end cap 44 has a divergent internal surface 45 and a corresponding divergent outer surface 46. A narrow gap exists between the proximal end of the outer front end cap and the distal side of the inner front end cap and this allows for some expansion of the gases into the expansion chamber 52. The outer front end cap 48 contains a modified convergent-divergent coanda nozzle 50, and is modified by the provision of two series of angled suction holes 51 that are angled towards the proximal end of the suppressor and improve the suction effect provided by the modified convergent-divergent coanda nozzle.

The basic operation of the cooling system of FIG. 3 is similar to that of FIG. 1 in that the hot muzzle gases exiting from the host sound suppressor are used as a driving fluid to provide aspiration of cool ambient air along the outer surface of the host sound suppressor. The cool ambient air is the driven fluid and this method of operation is the reverse of the conventional air injectors or ejectors. The hot muzzle gases, although much reduced in pressure and heat after passing through the baffles 41 and expansion chambers 42 of the host sound suppressor, flow from the host sound suppressor forward into the expansion chamber 52. The compressed muzzle gases expand outwards but are then directed onto the curved surface of the modified convergent-divergent coanda nozzle 48 and due to the coanda effect then follow the curved surface forward. As the gases flow past the two sets of angled holes 51, this creates a suction effect. The suction effect is created by the gases flowing past the first set of angled holes 51 and this suction effect is then enhanced by the gases flowing past the second set of angled holes which are positioned in alignment with the annular gap 53. The suction effect or aspiration effect results in cool ambient air being sucked in from the proximal end of the host sound suppressor through the annular gap 53 formed by the shroud 49 and the outside surface of the host sound suppressor 40. This cool air is sucked along the length of the host sound suppressor and results in cooling of the suppressor.

The sound suppressor cooling system as shown in FIG. 4 is similar to that of FIG. 1 in that it comprises of a shroud 68 that fits over the sound suppressor, and the outer front end cap 67. The shroud is cylindrical and an annular gap 72 is formed between the inside surface of the shroud and the outside surface of the host sound suppressor 60. It should be understood that the described shape is for descriptive purposes only, and the shape of the shroud may vary depending upon the shape of the host sound suppressor. The shroud may cover a portion of the host sound suppressor or it may cover the entire length as shown in FIG. 4. As with the cooling system of FIG. 1, the shroud is supported at its proximal and distal ends and the host sound suppressor may be provided with shoulders, bearing surfaces or flutes while the inside surface of the shroud may be smooth, and the functional aspects are similar to the description relating to the embodiment of FIG. 1 in relation to FIGS. 6A and 6B where longitudinal vanes or flutes 82 and circumferential bearing surfaces or shoulders 83 are shown with a shroud having a smooth inside surface. Alternatively, the shroud 28 may be provided with circumferential bearing surfaces or shoulders or longitudinal vanes or flutes and one such arrangement of support is shown in FIG. 5B where longitudinal flutes 80 are shown on the internal surface of a shroud with the outside surface of the host suppressor being smooth as shown in FIG. 5A. Such arrangements of longitudinal vanes or flutes, or circumferential bearing surfaces or shoulders may be used depending upon the type of host firearm that the suppressor is used with, such as a machine gun or an automatic rifle. The longitudinal vanes or flutes, and circumferential bearing surfaces or shoulders provide support to the shroud regardless of the longitudinal vanes or flutes, or circumferential bearing surfaces or shoulders being positioned externally on the suppressor housing or internally on the shroud. These support features also assist in heat transfer from the sound suppressor to the shroud via the support features. The proximal and distal bearing surfaces or shoulders are provided with recesses that allow for the ambient air to be aspirated from the proximal end towards the distal end. The forward or distal end of the shroud 68 abuts against a shoulder on the outer front end cap 67. The inner front end cap 64 and the outer front end cap 67 are positioned so that the distal face of the inner front end cap 64 abuts against the proximal face of the outer front end cap 67. An expansion chamber 71 is formed around the junction of the inner front end cap 64 of the host sound suppressor and the outer front end cap 67. This expansion chamber 71 allows for the expansion of the hot muzzle gases from the host sound suppressor and at the same time the cool ambient air is sucked into the chamber due to the suction effect produced by the nozzle that is a part of the outer front end cap 67. The inner front end cap has a short forward reduced diameter protrusion 66 that has an increased size bore as compared to bore hole 65 of the inner front end cap. The proximal end of the outer front end cap 67 fits against the inner front end cap 64. The outer front end cap 67 contains a shallow divergent nozzle 69. Divergent nozzle 69 is provided with two series of angled holes 70 that assist in creating a suction effect. An annular gap 72 is formed between the shroud 68 and the housing 60.

The operation of the cooling system of FIG. 4 is similar to that of FIG. 1 in that the hot muzzle gases exiting from the host sound suppressor are used as a driving fluid to provide aspiration of cool ambient air along the outer surface of the host sound suppressor. The cool ambient air is the driven fluid and this method of operation is the reverse of the conventional air injectors or ejectors. The hot muzzle gases, although much reduced in pressure and heat after passing through the baffles 61 and expansion chambers 62 of the host sound suppressor, flow from the host sound suppressor forward into the expansion chamber 71. The compressed muzzle gases expand before flowing forward through the divergent nozzle 69 and pass by the angled holes 70. As the gases flow past the two sets of angled holes 70, this creates a suction effect. The suction effect is created by the gases flowing past the first set of angled holes 70 and this suction effect is then enhanced by the gases flowing past the second set of angled holes which are positioned in alignment with the annular gap 72. The suction effect or aspiration effect results in cool ambient air being sucked in from the proximal end of the host sound suppressor through the annular gap 72 formed by the shroud 68 and the outside surface of the host sound suppressor 60. This cool air is sucked along the length of the host sound suppressor and results in cooling of the suppressor.

The host sound suppressor in each of the embodiments described herein has a series of baffles and expansion chambers between the baffles that are used for reduction of gas pressure and heat with a subsequent reduction in sound. The baffles illustrated in each of the embodiments are simple flat baffles. It should be realized that this is for illustrative purposes only, and those skilled in the art may use other versions of baffles as so required.

The embodiments described herein feature various inner front end caps and outer front end caps and it should be realized that while various embodiments use various arrangements of end caps and these arrangements have been described in detail, such arrangements are not specifically binding. Depending upon the type of host firearm, one may use a particular inner front end cap with a different outer front end cap than has been described or illustrated herein.

Further, to improve the efficiency of the cooling system, the inner front end cap may be modified by the addition of a plurality of openings around the bore hole of the inner front end cap. It has been found that the addition of a plurality of openings to the inner front end cap enhances the suction effect achieved through the early venting of gases into the expansion chamber and then into the nozzle before exiting the sound suppressor.

The embodiments of the invention described herein are exemplary and numerous modifications, variations and rearrangements can be readily envisioned to achieve substantially equivalent results, all of which are intended to be embraced within the spirit and scope of the invention.

The invention claimed is:

1. A method of cooling a firearm sound suppressor comprising:

a. attaching a firearm sound suppressor to the muzzle of a firearm, said firearm sound suppressor having a shroud surrounding the exterior of said firearm sound suppressor, and whereby an annular chamber is formed between said shroud and said firearm sound suppressor; and b. cooling said firearm sound suppressor upon discharge of said firearm through means for producing a suction effect by using the gases discharged from said firearm sound suppressor, whereby said suction effect aspirates ambient air through said annular chamber and along the length of said firearm sound suppressor, and wherein said means for producing a suction effect includes a nozzle positioned at the distal end of said firearm sound suppressor and said shroud.

2. A firearm sound suppressor comprising:

a. a sound suppressor housing with means for reducing the pressure of gases exiting from a discharged firearm;

b. a shroud that is attached to the exterior of said sound suppressor housing, whereby an annular chamber is formed between said sound suppressor housing and said shroud; and c. means for producing a suction effect upon the discharge of gases from said firearm sound suppressor whereby said suction effect aspirates ambient air through said annular chamber, whereby cooling said firearm sound suppressor, and wherein the means for producing a suction effect includes a nozzle positioned at the distal end of said firearm sound suppressor and said shroud.

3. A firearm sound suppressor comprising:

a. a sound suppressor housing with means for reducing the pressure of gases exiting from a discharged firearm;

b. a shroud that is attached to the exterior of said sound suppressor housing, whereby an annular chamber is formed between said sound suppressor housing and said shroud; and c. means for producing a suction effect upon the discharge of gases from said firearm sound suppressor whereby said suction effect aspirates ambient air through said annular chamber, thereby cooling said firearm sound suppressor and wherein the means comprises:

a nozzle positioned at the distal end of said shroud;

said nozzle positioned forward of the front end cap of said firearm sound suppressor; and an expansion chamber formed between said front end cap of said firearm sound suppressor, said nozzle and said shroud, wherein upon said discharge of said gases from said firearm sound suppressor into said expansion chamber and hence into said nozzle creates said suction effect, whereby cooling said firearm sound suppressor.

4. A firearm sound suppressor of claim 3, wherein said means further comprises:

a. said front end cap of said firearm sound suppressor is a convergent nozzle, and b. said nozzle is a tubular nozzle having a convergent proximal surface.

5. A firearm sound suppressor of claim 3, wherein said means further comprises:

a said front end cap of said firearm sound suppressor is a tubular nozzle, and b. said nozzle is a tubular nozzle having a series of angled holes, whereby said angled holes are angled towards the proximal end of said sound suppressor.

6. A firearm sound suppressor of claim 3, wherein said means further comprises:

a. said front end cap of said firearm sound suppressor is a divergent nozzle, and b. said nozzle being a convergent-divergent coanda nozzle, said convergent-divergent coanda nozzle having at least one series of angled holes, whereby said angled holes are angled towards the proximal end of said sound suppressor.

7. A firearm sound suppressor of claim 3, wherein said means further comprises:

a. said front end cap of said firearm sound suppressor is a tubular nozzle, and b. said nozzle being a divergent nozzle, said divergent nozzle having one or more series of angled holes, whereby said one or more series of angled holes are angled towards the proximal end of said sound suppressor.

8. A firearm sound suppressor of claim 3, wherein said shroud has vanes, flutes, circumferential bearing surfaces or shoulders on the internal surface of said shroud.

9. A firearm sound suppressor of claim 3, wherein said shroud has vanes or flutes and where said vanes or flutes have a helical, curvilinear or stepped curvilinear shape.

10. A firearm sound suppressor of claim 3, wherein said sound suppressor housing has vanes, flutes, circumferential bearing surfaces or shoulders on the external surface of said sound suppressor housing.

11. A firearm sound suppressor of claim 3, wherein said sound suppressor housing has vanes or flutes have a helical, curvilinear or stepped curvilinear shape.

12. A firearm sound suppressor of claim 3, wherein said front end cap of said sound suppressor has a plurality of holes, said holes positioned around the bore hole of said front end cap of said firearm sound suppressor, and whereby said plurality of holes vent gases from said firearm sound suppressor forward into said expansion chamber.

* * * * *